US009551045B2

(12) United States Patent
Guliana et al.

(10) Patent No.: US 9,551,045 B2
(45) Date of Patent: Jan. 24, 2017

(54) FLEXIBLE MINIMUM ENERGY UTILIZATION ELECTRIC ARC FURNACE SYSTEM AND PROCESSES FOR MAKING STEEL PRODUCTS

(71) Applicants: John A. Guliana, Skokie, IL (US); Guy A. Brada, Chicago, IL (US); Christian H. Ericksen, Chicago, IL (US); Bruce C. Liimatainen, Riverside, IL (US); Algirdas A. Underys, Arlington Heights, IL (US)

(72) Inventors: John A. Guliana, Skokie, IL (US); Guy A. Brada, Chicago, IL (US); Christian H. Ericksen, Chicago, IL (US); Bruce C. Liimatainen, Riverside, IL (US); Algirdas A. Underys, Arlington Heights, IL (US)

(73) Assignee: A. FINKL & SONS CO., Chicago, IL (US)

( * ) Notice: Subject to any disclaimer, the term of this patent is extended or adjusted under 35 U.S.C. 154(b) by 119 days.

(21) Appl. No.: 13/998,277

(22) Filed: Oct. 18, 2013

(65) Prior Publication Data

US 2015/0107797 A1 Apr. 23, 2015

Related U.S. Application Data

(63) Continuation-in-part of application No. 13/134,027, filed on May 27, 2011, now Pat. No. 8,562,713.

(51) Int. Cl.

| | |
|---|---|
| ***C21C 7/10*** | (2006.01) |
| ***C21C 7/00*** | (2006.01) |
| ***B22D 41/015*** | (2006.01) |
| ***B22D 41/08*** | (2006.01) |
| ***B22D 41/44*** | (2006.01) |
| ***B22D 1/00*** | (2006.01) |
| ***C21C 5/52*** | (2006.01) |
| ***F27B 3/08*** | (2006.01) |

(Continued)

(52) U.S. Cl.

CPC ..... *C21C 7/0075* (2013.01); *B22D 1/002* (2013.01); *B22D 41/015* (2013.01); *B22D 41/08* (2013.01); *B22D 41/44* (2013.01); *C21C 5/5211* (2013.01); *C21C 5/5229* (2013.01); *C21C 5/5252* (2013.01); *C21C 5/5294* (2013.01); *C21C 7/072* (2013.01); *C21C 7/10* (2013.01); *F27B 3/085* (2013.01); *F27B 3/19* (2013.01); *F27D 3/1509* (2013.01); *C21C 2300/08* (2013.01)

(58) Field of Classification Search

CPC ..... C21C 7/0075; C21C 7/10; C21C 5/5229
USPC ..... 266/236
See application file for complete search history.

(56) References Cited

U.S. PATENT DOCUMENTS 3,955,964 A * 5/1976 MacDonald et al. ..... 75/10.42
5,252,120 A * 10/1993 Finkl et al. ..... 75/508

(Continued)

*Primary Examiner* — Scott Kastler
(74) *Attorney, Agent, or Firm* — James G. Staples

(57) ABSTRACT

In an electric arc furnace system for making steel, a method and structure (1) for eliminating teeming hang-ups and ensuring temperature homogeneity in a ladle which teems into an ingot mold by gas purging at all possible steps under both atmospheric and vacuum conditions, and (2) for preventing non-metallic inclusions from appearing in the final product by deflecting the granular material in the teeming ladle well block away from the ingot mold by a heat resistant but combustible deflector just prior to entry of the teeming stream into the ingot mold.

8 Claims, 9 Drawing Sheets

(51) Int. Cl.

| | |
|---|---|
| ***F27B 3/19*** | (2006.01) |
| ***C21C 7/072*** | (2006.01) |
| ***F27D 3/15*** | (2006.01) |

(56) References Cited

U.S. PATENT DOCUMENTS

| | | | | |
|---|---|---|---|---|
| 8,562,713 | B2 * | 10/2013 | Guliana et al. | 75/10.66 |
| 2009/0246068 | A1 * | 10/2009 | Pretorius | 420/129 |
| 2010/0276102 | A1 * | 11/2010 | McQuillis et al. | 164/4.1 |
| 2015/0107797 | A1 * | 4/2015 | Guliana et al. | 164/495 |

* cited by examiner

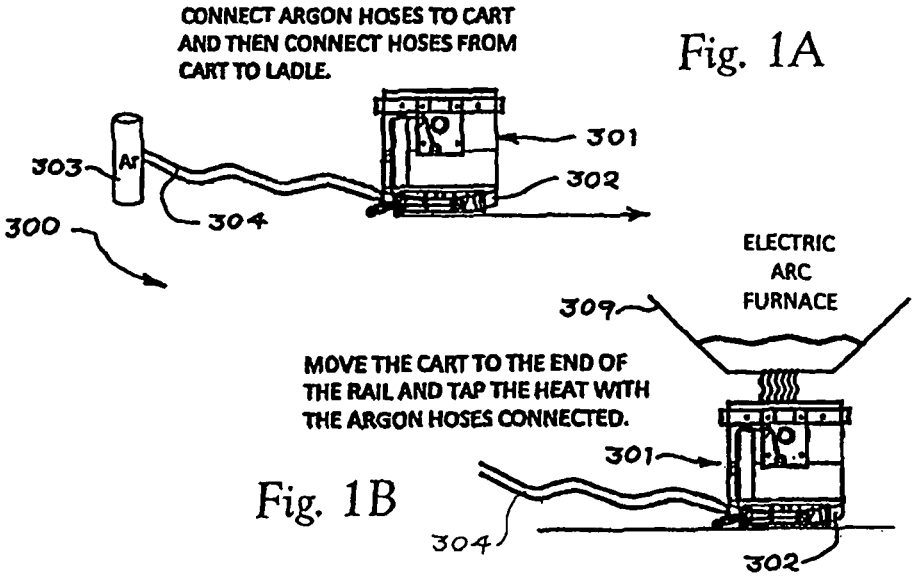
Fig. 1A
Fig. 1B
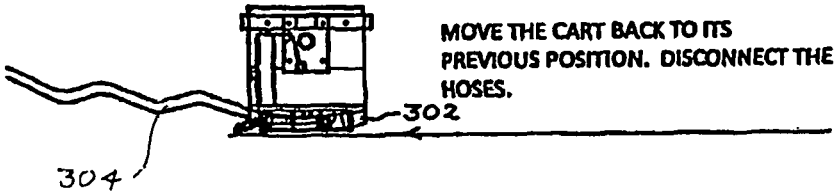
Fig. 1C
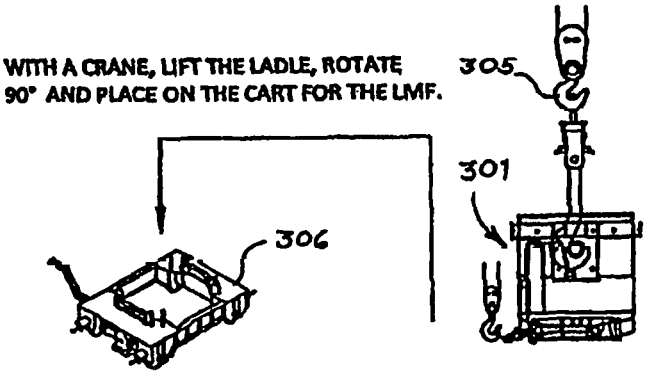
Fig. 1D

Fig. 1E
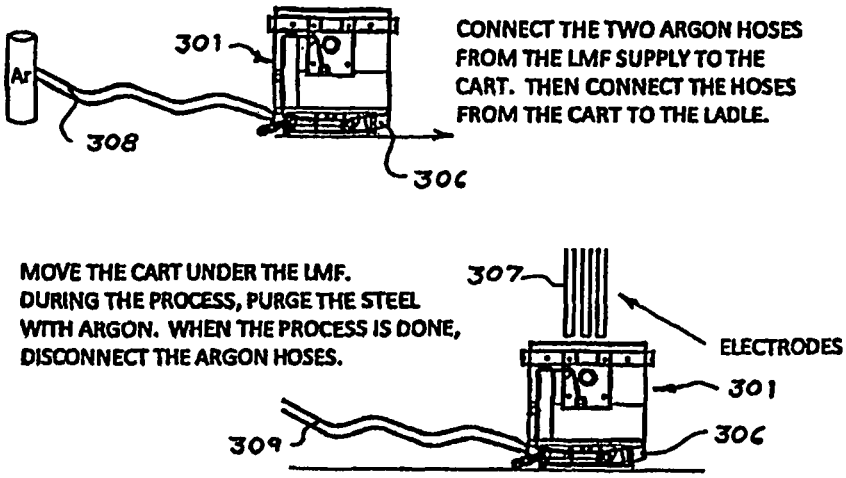
Fig. 1F
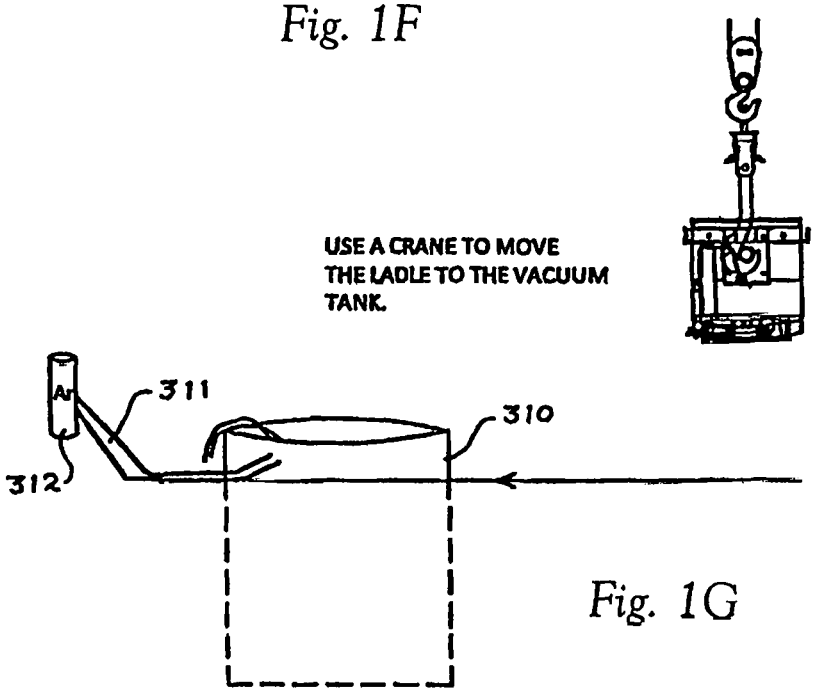
Fig. 1G

TRANSFER TO TEEMING PIT AND, WHILE EMPTYING THE LADLE, PURGE SHROUD ATTACHED TO TRUMPET WITH ARGON.

FLEXIBLE MINIMUM ENERGY UTILIZATION ELECTRIC ARC FURNACE SYSTEM AND PROCESSES FOR MAKING STEEL PRODUCTS

This application is a continuation-in-part of application Ser. No. 13/134,027 filed May 27, 2011, now U.S. Pat. No. 8,562,713.

BACKGROUND OF THE INVENTION

The invention disclosed in that application relates to electric arc furnace steel making systems and specifically to such systems having a ladle metallurgical furnace therein, which systems have the advantage of requiring decreased energy input per unit of steel produced compared to prior art systems. It is particularly directed to making alloy steel at a rate limited only by the maximum melting capacity of the arc furnace. In addition the invention, without modification, is adaptable to nearly every end use found in the steel industry today and particularly to producing unique, one of a kind heats of widely varying compositions in a randomized production sequence.

For example, the invention disclosed therein makes possible the production of up to four different types of steel (as distinct from grades of steel) in a single electric arc furnace system without slowdown or delay in the processing sequence of heats regardless of the number or randomized order of the different types of steel to be made in a campaign. Thus the system will produce at least non-vacuum arc remelt steel, vacuum arc remelt steel, vacuum oxygen decarburized non-vacuum arc remelt steel and vacuum oxygen decarburized vacuum arc remelt steel as well as vacuum treated ladle metallurgical furnace steel.

Now, although the process time from the charging of the electric furnace to teeming in the invention disclosed in said application is considerably shorter than the charge to teem time in conventional electric furnace steel making, the time between furnace tap to teeming is not necessarily commensurably shortened because of the added step of ladle furnace treatment; indeed, the time span may equal or even somewhat exceed the time span in conventional electric furnace steel making due to the dwell time in the ladle metallurgical furnace. Although the ladle metallurgical furnace has heat input capacity, that capacity is considerably less than the heat input capacity of the electric arc furnace. As a consequence, and particularly in connection with the larger heat sizes experienced in the system of the aforesaid application, teeming problems may arise due to the tendency of the molten steel in the teeming vessel to cool an undesirable amount in the bottom of the teeming vessel. This cooling can adversely affect the teeming stream, as by forming a semi-solid plug or glob in or above and adjacent to the teeming nozzle which can restrict the flow rate of the teem stream.

It is therefore highly desirable that the steel in the region of the teeming nozzle be just as fluid as the steel in the balance of the teeming vessel so that blockage or restricted flow through the teeming nozzle may be avoided.

A drawback to teeming systems that utilize granular material in the teeming nozzle of the teeming vessel is the possibility that at the moment the teeming stream begins the granular material may find its way into the molten metal receiving teeming receptacle and, eventually, into the final solidified product thereby causing serious cleanliness problems in the final product.

Accordingly a need exists to ensure that the teeming stream from the teeming vessel is as fluid as it can be, even in heats of over 100 tons; that is, the temperature of the molten steel in the region of the teeming nozzle should be as close to the temperature of the steel in the regions above the teeming nozzle as possible so that a restricted flow from the teeming nozzle (sometimes referred to as a hang-up) is avoided.

And as the cleanliness specifications of the final product become tightened it is more and more incumbent on the steel maker to ensure that no steel is rejected due to an undesirably high inclusion content attributable to the insulating granular material present in the teeming nozzle region, often referred to as the well block or well block region.

It is accordingly an object of the invention disclosed herein to provide, in a system having a single arc furnace, a single metallurgical furnace and a single vacuum treatment station means for ensuring that teeming stream difficulties, such as hang-ups, do not arise due to a temperature differential between the molten steel adjacent the well block in a teeming ladle and regions of the steel remote from the well block.

Another object of the invention is to decrease or eliminate the presence of undesirable inclusions in the final, solidified product attributable to the presence of granular material in the passage in the nozzle of the teeming vessel.

BRIEF DESCRIPTION OF THE SEVERAL VIEWS OF THE DRAWING

The invention is illustrated more or less diagrammatically in the accompanying drawing in which FIG. 1, consisting of sub-parts 1A through 1J, inclusive, is a schematic view of the system of the invention showing particularly the means for eliminating teeming nozzle hang-up with certain parts indicated schematically or by legend for ensuring the temperature uniformity of a heat of steel being tapped into a teeming receiving receptacle, such as an ingot mold.

Like numerals will be used to refer to like or similar parts from Figure to Figure of the drawing.

DETAILED DESCRIPTION OF THE INVENTION

Figure 1H:
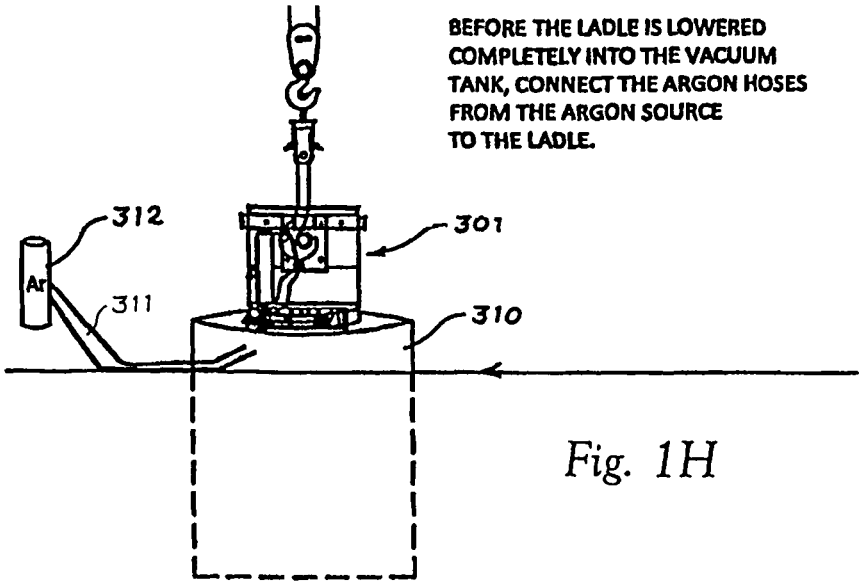
Figure 1I:
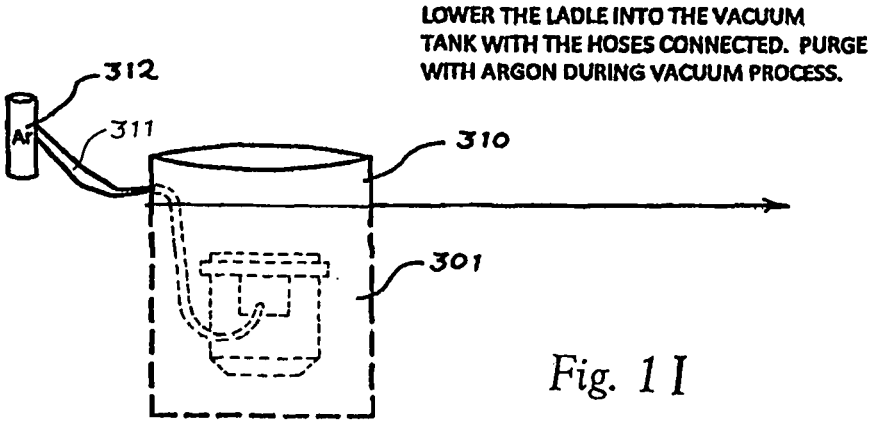
Figure 1J:
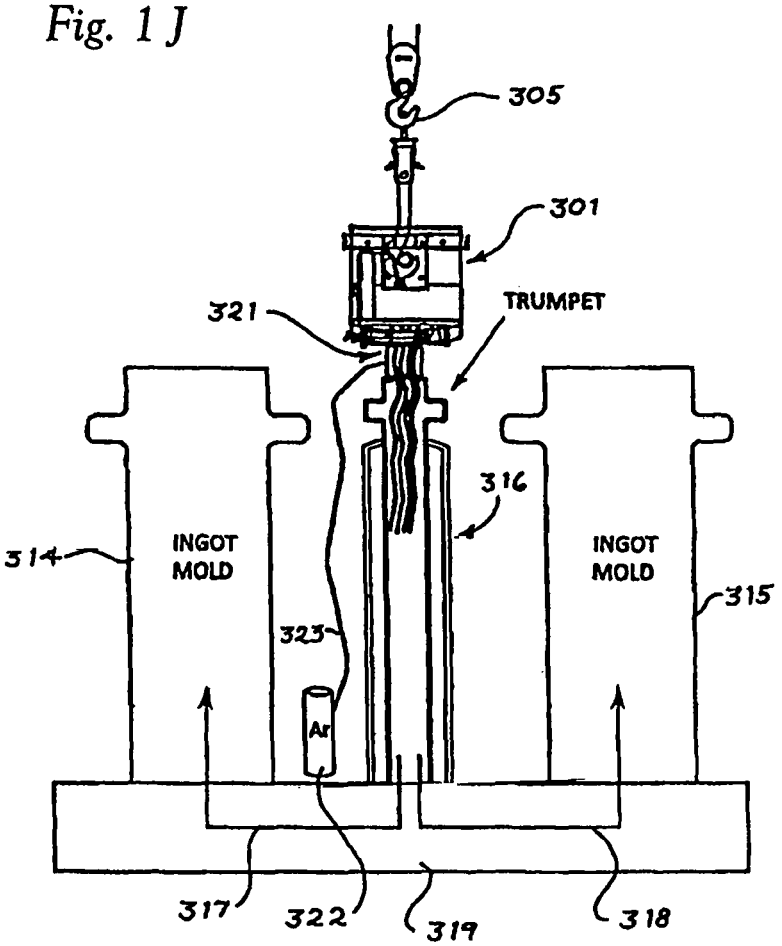

The system and method for insuring that the molten metal at the teeming station is as fluid as it can be within the limitations of time and available equipment, and teeming problems thereby reduced or entirely eliminated, is indicated at 300 in FIG. 1 which consists of sub-FIGS. 1A through 1J inclusive. In the description of the elements and processing steps in FIG. 1, a familiarity with the disclosure in said U.S. Pat. No. 8,562,713 will be assumed, although for the sake of clarity of description herein certain elements in said patent may be referenced by reference numerals different from those used in said patent.

FIG. 1A shows a tapping ladle, indicated generally at 301 (which is similar or functionally equivalent to tapping vessel 72 of said patent), said tapping ladle 301 being shown in its condition just prior to being moved into tapping position from the electric arc furnace 309 which is the melting unit of the system. In its the FIG. 1A position of tapping ladle 301, a source of inert gas under pressure, preferably argon, is indicated at 303, the source being connected by line 304 to a connection, not shown for purposes of clarity, to tapping cart 302. It will be understood that the argon connection on the tapping cart will be connected to the ladle 301 in a manner now well known in the art, an example of which is shown in the right portion of FIGS. 2-4.

Following connection of the argon source 303 to the ladle 301 the ladle is moved to the position of FIG. 1B where the electric arc furnace 309 is schematically shown to be tapping into the ladle 301.

In FIG. 1C the ladle 301 now containing a heat of molten steel has been moved back to the position of FIG. 1A, and the argon connection between the tapping cart 302 and the ladle 301, and between the source of inert gas 303 and the ladle 301 have been disconnected in order for the ladle to be subsequently moved by crane. The inert gas was bubbled upwardly through the heat of molten metal in the tapping cart 302 during all, or substantially all, of the time of tapping to promote temperature uniformity in the ladle at the end of tapping.

In FIG. 1D, the tapping ladle 301, hereafter sometimes referred to merely as "the ladle", is lifted by crane 305 and placed on a ladle metallurgical furnace cart 306 preparatory to undergoing treatment in the ladle metallurgical furnace, sometimes hereinafter referred to as the LMF.

In FIG. 1E an argon hose 308 has been connected from an argon supply associated with the LMF cart 306 and then an argon connection is made between the cart 306 and ladle.

In FIG. 1F the LMF cart 306 carrying ladle 301 is moved under the LMF electrodes 307 which provide heat input to the heat during the LMF processing which usually includes make-up alloy additions. Just prior to initiation of the processing in the LMF the ladle 301 will have been connected to a source of inert gas by a hose indicated at 309 so that inert gas can be bubbled through the heat in the ladle as heat is added by the electrodes 307 to maintain temperature homogeneity in the heat during LMF treatment.

At the conclusion of LMF treatment the ladle 301 is disconnected from the inert gas line 309 in preparation for movement of the ladle to the next processing station.

In FIG. 1G the ladle 301 is shown being crane lifted into a vacuum tank 310 which has an inert gas line 311 connected to a source of inert gas 312, preferably argon.

Referring now to FIGS. 1H and 1I, after the ladle 301 is lowered completely into vacuum tank 310, argon hoses 313 are connected to ladle 301.

In FIG. 1I the ladle 301 has been shown lowered into the vacuum tank 310 with the inert gas hoses connected to the source 312 of inert gas. The heat in the ladle 301 is purged with the inert gas which enters the heat at a location remote from the surface while the ladle is subjected to vacuum on the order of a few mm of Hg, and, if desired, in some cases at 0.5 torr.

After the vacuum purging process in tank 310 is completed, the inert gas hose connections to the ladle are disconnected and the ladle lifted by crane 305 and transferred to the teeming station shown in FIG. 1J.

A bottom pour ingot system is shown more or less diagrammatically in FIG. 1J, the system including ingot molds 314 and 315 which are connected to a generally centrally placed pouring trumpet system, indicated generally at 316, by runners 317 and 318 in mold stool 319, by which the molds 317 and 318 will be filled from the bottom up.

A pouring shroud is indicated generally at 321, the shroud being connected to a source 322 of inert gas by hose 323.

The pouring shroud system 321 and the pouring trumpet system 316, and their mode of operation, are shown to a larger scale in FIGS. 2 through 10.

Figure 2:
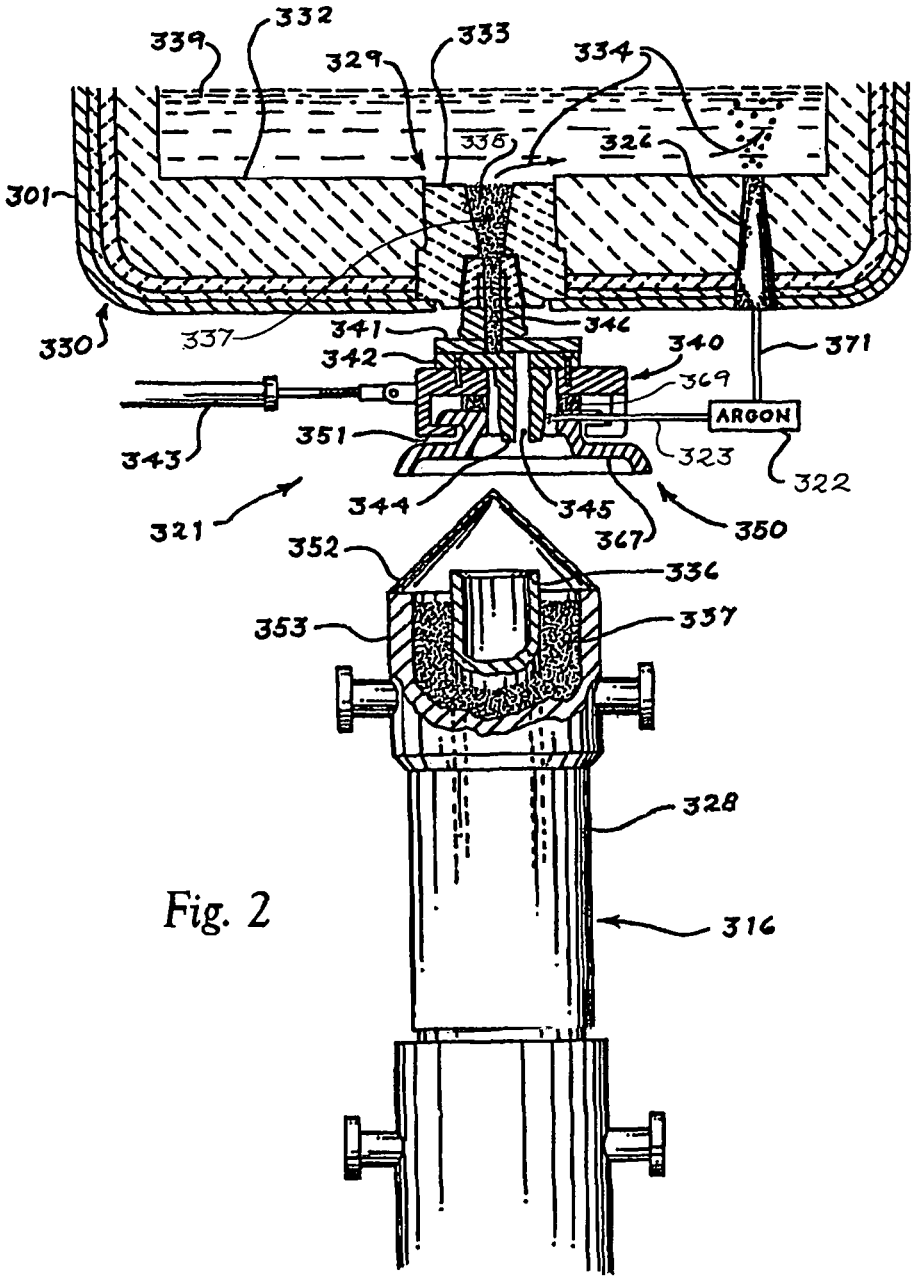
FIG. 2 is a partial cross-section of the teeming set-up just prior to the commencement of teeming with parts broken away for clarity.

In FIG. 2 the ladle 301 is shown to have one or, preferably, more, purging plugs 326 in its bottom indicated generally at 330, the plug or plugs 326 being connected by inert gas line 371 to a source of inert gas under pressure shown at 322.

A well block is indicated generally at 329 and located, here, in the center of the bottom 330. The well block is preferably composed of a high heat resistant refractory, such as alumina or magnesia. Its upper end 333 is substantially flush with the upper refractory surface 332 of the bottom 330. As the bubbles of inert gas exit from the upper surface of the purging plug 326 they will expand several hundred times in volume due to the Boyle and Charles laws of gas expansion since the temperature of the molten metal will be very high, and, in the case of steel, approximately 3000° F. at this stage of the process. The movement of the gas bubbles generates a circulation of the molten metal which is indicated by the arrows 334. This circulation continually moves molten metal across the upper refractory surface 332 of the bottom 330 and the flush or substantially, flush, upper surface 333 of the well block 329.

As a result of the continuous circulation set up by the purging gas, there will be identity, or near identity, of the temperature of the molten metal across the entire bottom of the ladle 301, including the upper surface 333 of the well block 329. Thus, since the temperature will be uniform and the molten metal in constant movement as long as the purging gas is admitted to ladle 301, the tendency of the molten metal in the region of the well block to form a semi-solid or even slushy glob over the well block will be eliminated. As a consequence, when teeming begins no obstruction of the pouring passage 334 of the well block 329 will occur, and hence there will be no degradation of the teeming stream, which obstructions have been referred to by the steel industry as "hang ups", and hence the ladle 301 will be emptied in the shortest possible time with the teemed steel being only minimally cooled.

FIGS. 2 through 10 also disclose a means and method for insuring that undesirable inclusions will not appear in the final solidified product.

Referring first to FIG. 2 it will be seen that the center line of the well block pouring passage 335 is vertically aligned with the vertical center line of the vertical refractory tube 336 which is centered by sand 337 inside the upper end portion 338 of the pouring trumpet system 316. However downward passage of the molten metal 339 through the pouring passage 335 is precluded by the slide gate system indicated generally at 340. The slide gate system includes an upper stationary plate 341 having a teeming passage 346 and a lower, slidable plate 342 which is connected by bolts to a slide gate activator 343 which is shown in its closed position in FIG. 2. Slidable plate 342 has secured thereto by any suitable means a nozzle 344 having a central passage 345.

When the slide gate activator 343 is retracted leftward as viewed in FIG. 2, the slidable plate 342 will be moved to the left so as to align lower slide gate passage 345 with upper slide gate teeming passage 346 thereby allowing molten metal in ladle 301 to move from the ladle into the pouring trumpet system 316.

In the slide gate closed position of FIG. 2 the pouring passages 335 and 346 are shown filled with a heavy granular material having a specific gravity greater than the specific gravity of the molten metal. Since the upper, open end of pouring passage 335 is no higher than, and preferably slightly below the upper refractory surface 332 of bottom 330, the granular material will not be washed away from its illustrated position by the moving current of molten metal in ladle 301 represented by arrows 334 caused by the upward passage of the purging gas.

Figure 3:
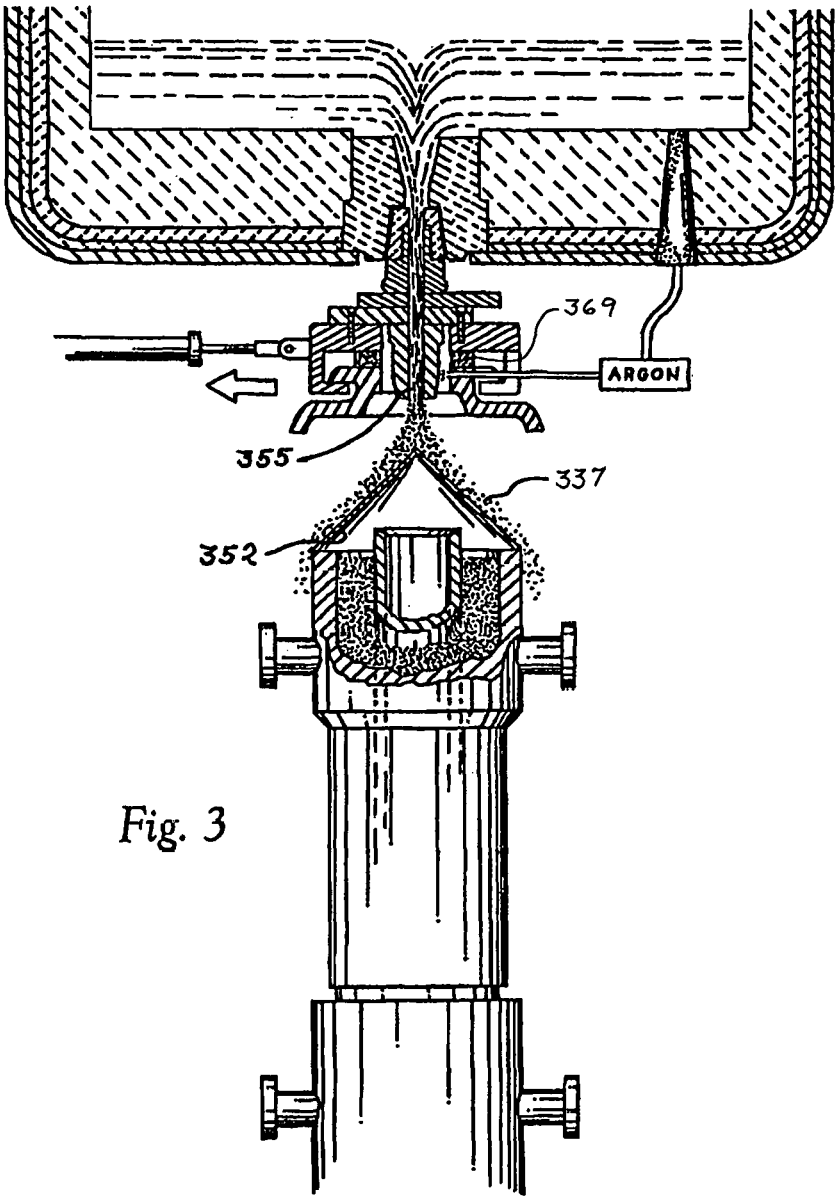
FIG. 3 is a cross-section of the teeming set-up with parts broken away for clarity showing the condition of the elements just after the slide gate has been activated to release the disposable granular blocking material in the teeming mechanism and the initiation of the teeming stream.
Figure 4:
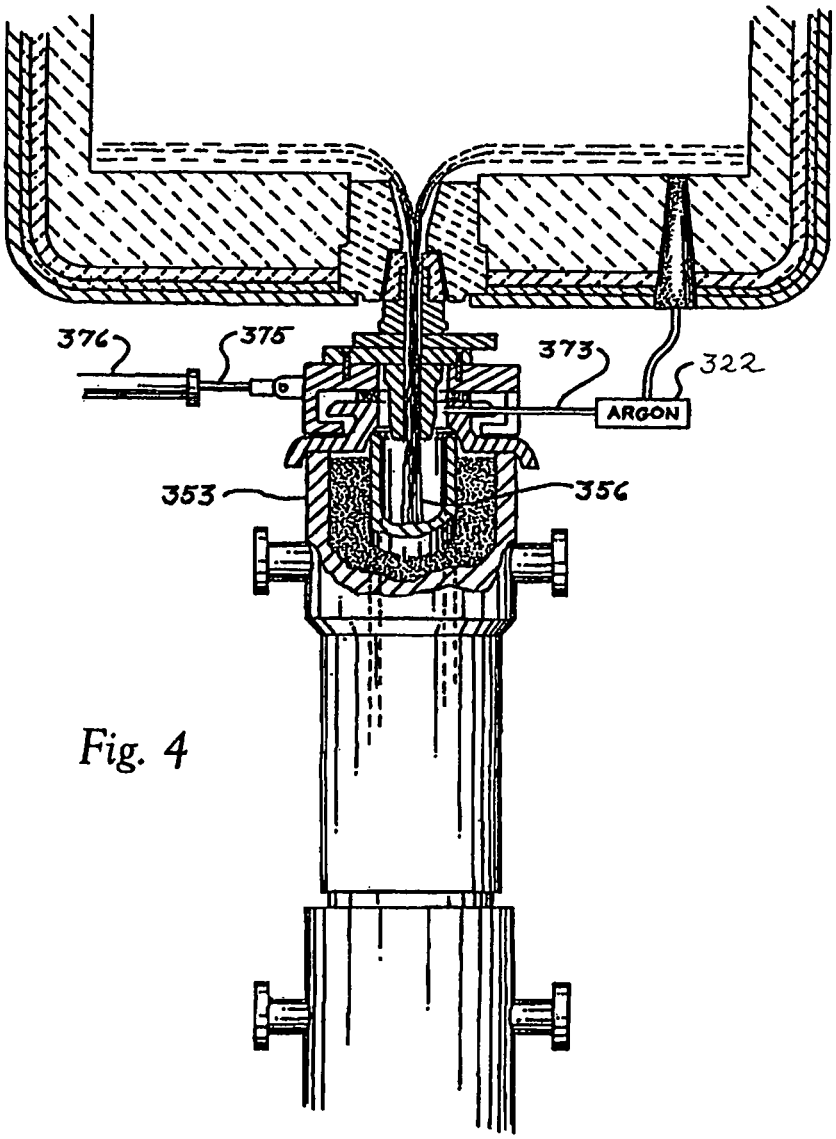
FIG. 4 is a cross-section with parts broken away similar to FIG. 3 showing the condition of the elements a moment after the disposable granular blocking material has been deflected away from the flow path of the teeming stream and a protective chamber formed around the teeming stream.

The contours of the components of the purging shroud system indicated generally at 321 and the physical operation of the pouring shroud system can be seen best in FIGS. 2, 3 and 4.

Figure 5:
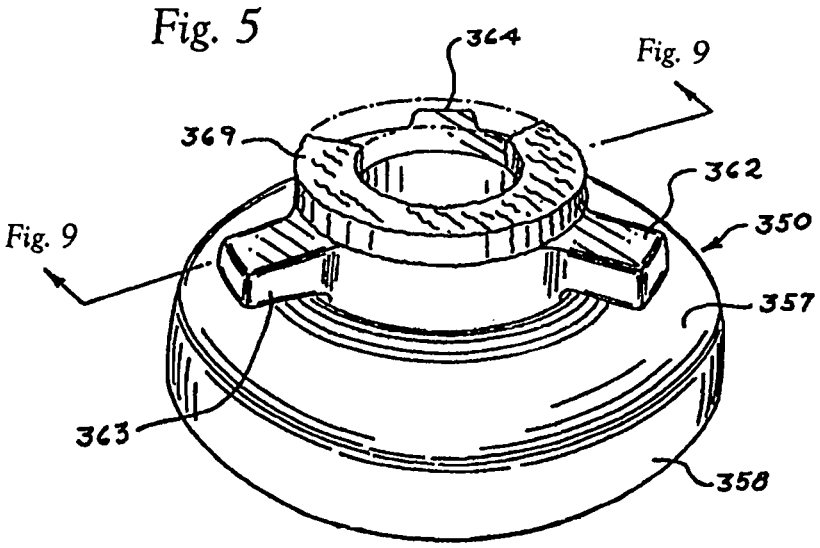
FIG. 5 is a perspective view of the pouring shroud used to form a partial seal about the pouring stream.
Figure 6:
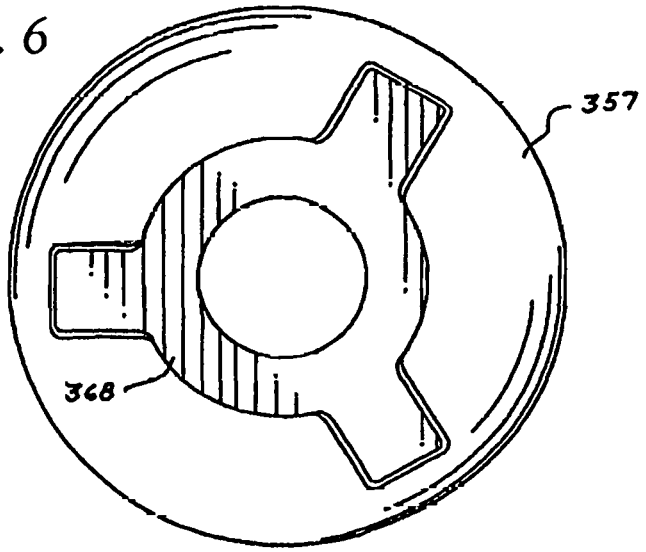
FIG. 6 is a top plan view of the pouring shroud.
Figure 7:
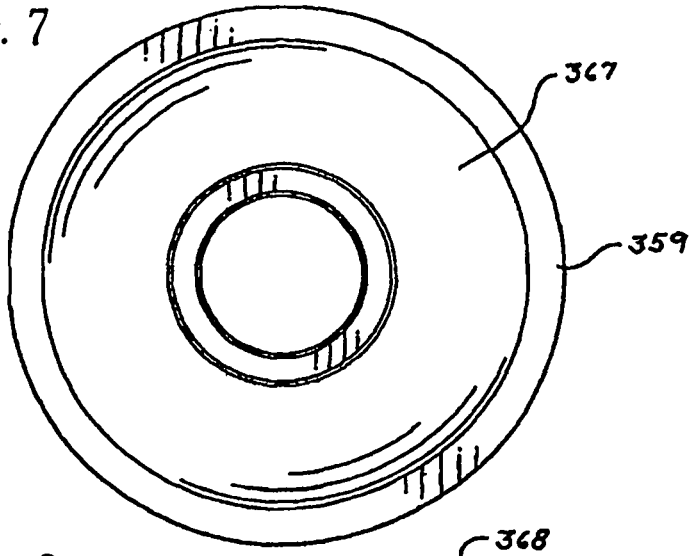
FIG. 7 is a bottom plan view of the pouring shroud.
Figure 8:
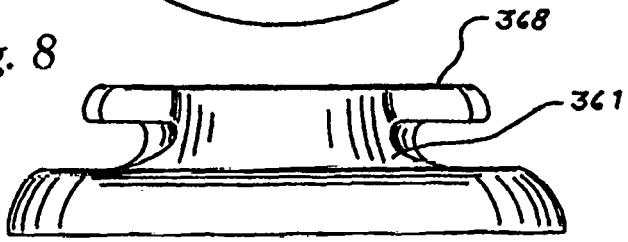
FIG. 8 is a side view of the pouring shroud.
Figure 9:
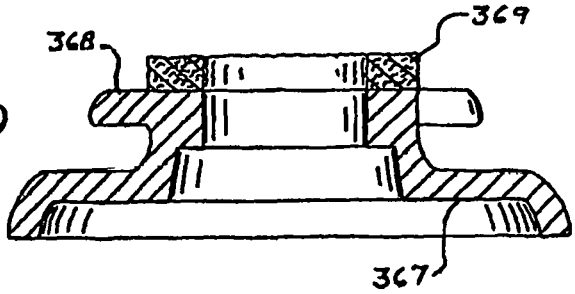
FIG. 9 is a vertical section through the pouring shroud taken along line 9-9 of FIG. 5.
Figure 10:
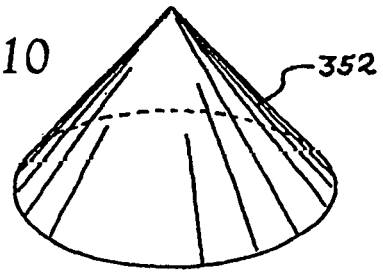
FIG. 10 is a perspective of the cone of FIGS. 2 and 3.

In FIGS. 2, 3 and 4 a pouring shroud indicated generally at 350 in an inoperative condition is shown in FIG. 2, and in an operative condition in FIGS. 4 and 5.

In FIG. 2 in particular the pouring shroud 350 is shown connected to the lower slide 342 of the slide gate system 340 by wedging clamps 351. A cone shaped cover 352 of high heat resistant but combustible material is shown in section in FIG. 2 and in perspective in FIG. 10. Any suitable materials may be used so long as it possesses the quality of physical integrity up to around 500° F. and combustibility at temperatures above that number. The circular bottom of the cone 352 rests on the upper mating surface of the top section 328 of the pouring trumpet system 316. The vertical axis of the cone 352 is aligned with the central vertical axes of the upper slide gate teeming passage 346 and the lower slide gate nozzle passage 345.

The moment the lower slide gate 342 is moved to the left as shown in FIG. 3, the two passages 345 and 346 will be aligned with one another, and the granular material 335 will drop downward toward the pouring trumpet system 316 and this condition, which is almost instantaneous, is shown in FIG. 3. The granular material will hit the cone 352 at or near its center and deflect radially outwardly to fall harmlessly to the bottom of the teeming pit; i.e.: it will not enter the upper end portion 338 of the pouring trumpet. However the heat of the granular material soon exceeds the combustion point of the cone 352 and the cone quickly disintegrates, the cone 352 having done its task of deflecting the granular material away from the vertical refractory tube 336 of the pouring trumpet system. The beginning 355 of the teeming stream immediately follows the removal of the granular material as shown in FIG. 3, and within a fraction of a second the teeming stream is in full flow condition 356 as seen in FIG. 4. By the time the full flow condition 356 of FIG. 4 is established, the cover 352, or, more accurately, the remnants thereof, will have disappeared from the system.

The pouring shroud 350, which is shown in its non-operative positions in FIGS. 2 and 3 and in its operative condition in FIG. 4, is shown in detail in FIGS. 5 through 9.

Referring first to FIG. 5 it will be seen that the shroud 350 takes roughly the shape of an inverted bowl having a substantially flat section 357 with a flange 358 extending downwardly therefrom. The lower circular edge 359, see FIG. 7, of the flange 358 extends around the outside periphery of the upper end portion of the top section 353 of the pouring trumpet as seen in FIG. 4. The central area of the shroud 350 has an upwardly extending neck area indicated at 361 which includes, at its upper end, in this instance, three radically outwardly extending locking lugs 362, 363 and 364, see FIG. 5, which lugs are contoured to mate in supporting contact with inwardly extending locking flanges 365, 366 as best seen in FIG. 3. The upper flat edge 368 of the neck portion 361 receives a ring of high temperature heat resistant fibrous ceramic material indicated at 369. The fibrous ring 369 is shown in its uncompressed state in FIGS. 3, 5 and 10, and in its compressed state in FIG. 4. The ring 369 rests on the flat upper circular surface 368 of the neck portion 361 of the shroud.

The source of inert gas, such as argon, under a pressure greater than atmospheric pressure, is indicated at 328, the source of gas being connected to the interior of the shroud by a gas line 373 shown best in FIG. 4.

Slide gate actuator 343 consists of a piston 375 actuated by cylinder 376 which moves the lower slide gate 342 from its blocking position of FIG. 2 to its open position of FIG. 3.

The use and operation of the invention is as follows.

The tapping ladle 301 is preferably pre-heated to a temperature on the order of about 2000° F. and then placed on the tapping ladle cart 302. After placement on the tapping cart an argon line 304 from a source 303 is connected to the cart and then a similar line is connected from the cart to the ladle.

The cart and the tapping ladle 301, with the argon hoses connected, are then moved under the tapping sprout of the electric arc furnace 309, see FIG. 1B, which may contain anywhere from 75 to 115 tons of metal or more. The molten metal in the furnace is then tapped into ladle 301. As the molten metal goes into the ladle 301 the argon gas source 303 is actuated and argon bubbles upwardly through the rising level of metal in the ladle during tapping. The bubbling action performs the dual function of causing good mixing of the molten metal with whatever additions have been added to the ladle prior to and/or during tapping, and promoting temperature uniformity throughout the tapped heat.

Upon conclusion of tapping the now filled ladle 301 of molten metal is moved back to its starting position and the argon hoses from the argon source 303 disconnected from the cart carrying the ladle.

Thereafter ladle is lifted off the tapping cart and placed on a ladle metallurgical furnace cart 306 as best seen in FIG. 1D.

One or more argon hoses 308 from the supply of argon at the LMF are then connected to the LMF cart, and then argon hoses are connected from the LMF cart to the ladle as shown in FIG. 1E.

Thereafter the LMF cart and ladle 301 are treated at the LMF station for a desired period of time during which chemical adjustments are usually made and heat is added from the LMF electrodes sufficient to ensure that the molten metal will be at a desired temperature during tap. The heat in ladle 301 is purged with argon gas during the dwell time in the LMF to ensure good mixing of the added alloys and to promote uniformity of temperature within the heat.

After treatment in the LMF the purging gas is disconnected and the ladle 301 moved to a vacuum degassing station as indicated in FIG. 1G.

Preferably, before the ladle 301 is lowered into the vacuum tank 310 at the vacuum treatment station, a source of inert gas 312 is connected to the ladle 301 as best seen in FIG. 1H.

Thereafter the ladle 301 is lowered into the vacuum tank which completely envelops it as shown in FIG. 1I and gas line 313 connected, and the heat purged by argon as the heat is subjected to absolute pressures on the order of about as low as 0.5 torr.

Following treatment at the vacuum station the ladle is moved to the teeming station of FIG. 1J and the heat in the ladle purged with argon during teeming into the pouring trumpet system 316 as best seen in FIG. 2.

The molten metal forming the teeming stream is further treated in a manner shown in greater detail in FIGS. 2 through 10.

Prior to teeming, and with the slide gate system 340 in the closed position of FIG. 2, a fibrous refractory high temperature resistant ceramic cone 352 is placed on the upper end portion 353 of the pouring trumpet system 321, the cone having the ability to withstand temperatures up to about 500° F. or somewhat higher before completely disintegrating.

At this time the well block 329 is filled with a granular material having a specific gravity greater than the molten metal so that said material will not be swept out of the upper slide gate teeming passage 346 by the generally horizontal current set-up within the metal 339 by the upward passage of purge gas bubbles entering the metal 339 through one or more purging plugs 326.

At this time the pouring shroud 350 is merely suspended from the clamp member 351 on the lower portion of the slide gate 342. In this condition the high heat resistant fibrous ring 369 of the pouring shroud system will be uncompressed as shown in FIG. 2.

When the ladle 301 is carefully lowered as in FIG. 4 the underside 367 of the shroud 350 will contact the upper edge of the top section 353 of the pouring trumpet and thereafter, by a slight further downward movement of the ladle 301, said underside 367 of shroud 350 will make a partial sealing contact with the upper edge of the top portion 353 of the pouring trumpet. At the same time, the non-compressed condition of the fibrous ring 369 in FIG. 2 will be compressed to the condition shown in FIG. 4.

The cone 352 shown in FIGS. 2 and 3 performs, during its very short operational life, the very important task of preventing undesirable particles from showing up as inclusions in the final solidified product. Thus, the moment the slide gate actuator 343 moves the lower plate 342 in the slide gate system 340 into alignment with the upper plate 341, the granular material 337 begins falling through the upper slide gate teeming passage 346 which is in alignment with the lower slide gate teeming passage 345. When the granular material 337 hits the apex of the cone 352 it is immediately deflected radially outwardly and downwardly away from the vertical refractory tube 336 in the upper end portion 353 of the pouring trumpet, and thus the granular material will not enter the pouring trumpet/ingot mold portion of the system. The contact is very brief because the temperature of the molten metal is on the order of about 3000° F. and as a consequence the cone 25 will burn up quickly having completed its task of preventing the granular material from entering in the system.

The molten metal will immediately follow the granular material as indicated at 355 in FIG. 3. As soon as the granular material 337 leaves the system the teeming stream 356 will flow freely into the pouring trumpet, see FIG. 4.

As soon as the under surface 367 of the flat section 357 makes contact with the top surface of the top section 353 of the pouring trumpet and the ring 369 is compressed as seen in FIG. 4, a closed chamber, in effect, is formed around the pouring stream 356, the pouring stream being isolated from the ambient atmosphere. It will be understood that since there is refractory to refractory contact between the vertical refractory tube 353 and the shroud 350, an absolutely gas tight seal is seldom, if ever, attained. However the inert gas from the argon supply 328, which is under a pressure greater than atmospheric, will displace the ambient atmosphere containing oxygen from the chamber formed around the teeming stream so that the teeming stream 356 will move through a non-oxidizing atmosphere.

Although a preferred embodiment of the invention has been disclosed, it will be apparent that the scope of the invention is not confined to the foregoing description, but only by the scope of the hereafter appended claims when interpreted in light of the relevant prior art.

The invention claimed is:

1. In a bottom pour mold system for producing a batch of very pure substantially uniform temperature alloy steel, said system having a single electric arc furnace, a ladle metallurgical furnace, vacuum degassing means and a bottom pour mold system having a pouring trumpet, a method consisting of the steps of forming a furnace charge consisting entirely of scrap to make a completely molten batch of steel in the electric arc furnace, providing a tapping ladle for receiving the batch of molten steel from the electric arc furnace, passing an inert gas upwardly through the tapped steel in the tapping ladle as the steel is tapped from the electric furnace into the tapping ladle, moving the tapping ladle containing the batch which has been subjected to the inert gas during tapping to the ladle metallurgical furnace, passing an inert gas upwardly through the batch while said batch is subjected to treatment in the ladle metallurgical furnace, and thereafter, following ladle metallurgical furnace treatment of the batch, subjecting the batch to the combined effect of vacuum and an inert gas in the vacuum degassing means, and thereafter teeming the batch into the pouring trumpet of the bottom pour mold system.

2. The method of claim 1 where the teeming of the batch into the pouring trumpet includes isolating the teeming stream from ambient atmosphere during teeming by passing the teeming stream through a shroud which makes contact, at its bottom, with the top of the trumpet, and, at its top, with the bottom of the tapping ladle holding the steel being teemed, the space contained within the bottom of the tapping ladle, the shroud and the top of the trumpet forming a chamber which is connected to inert gas having a pressure greater than atmospheric pressure, whereby contact of the teeming stream with oxygen in the ambient atmosphere is substantially precluded.

3. The method of claim 2 further characterized in that a virtually air tight seal between the bottom of the tapping ladle and the top of the shroud is formed by a heat resistant fibrous ceramic material, said seal being derived from the pressure of (a) the bottom of the tapping ladle against the top of the shroud, and (b) the bottom of the shroud against the top of the trumpet.

4. In a multi-station system for processing very pure alloy steel on a batch basis, said system having a single electric arc furnace, a ladle metallurgical furnace, a vacuum degassing station and a teeming station, a method consisting of the steps of providing a tapping ladle for receiving a batch of molten steel from the electric arc furnace, connecting the tapping ladle to inert gas and passing said inert gas upwardly through the tapping ladle during tapping, disconnecting the inert gas from the tapping ladle, thereafter moving the tapping ladle containing the tapped batch from the electric arc furnace to the ladle metallurgical furnace, connecting the tapping ladle to inert gas and passing said inert gas upwardly through the tapped batch as said batch is treated in the ladle metallurgical furnace, thereafter disconnecting the tapping ladle from the inert gas, thereafter moving the tapping ladle to the vacuum degassing station, connecting the tapping ladle to inert gas at the vacuum degassing station and passing said inert gas upwardly through the batch simultaneously with the subjection of the batch to a vacuum of about 0.5 torr to form very pure alloy steel, disconnecting the tapping ladle from the inert gas at the vacuum degassing station, thereafter moving the tapping ladle to a teeming station, connecting the tapping ladle to a source of inert gas, thereafter teeming the batch of ladle metallurgical furnace and vacuum treated molten steel into mold means at the teeming station, passing an inert gas upwardly through the treated molten steel as the steel is teemed, the treated molten steel forming a teeming stream between the bottom of the tapping ladle and the mold means, and shrouding the teeming stream with an inert gas to prevent contact of the teeming stream with ambient atmosphere during teeming.

5. The method of claim 4 further characterized by providing a bottom pouring mold system at the teeming station, said bottom pouring mold system including a pouring trumpet which feeds bottom pour ingot molds, said pouring trumpet being placed to receive the teeming stream.

6. A multi-station system for producing very pure alloy steel on a batch basis, said system including a tapping ladle, said tapping ladle having a bottom discharge passage and means for blocking and unblocking the bottom discharge passage, a single electric arc furnace having means for tapping a batch of molten steel in the furnace into the tapping ladle, a ladle metallurgical furnace which treats the molten steel in the tapping ladle, a vacuum station which treats the tapped steel in the tapping ladle at sub-atmospheric pressures down to 0.5 torr, and a teeming station, said teeming station including a bottom pouring system for receiving molten steel passing through the bottom discharge passage of the tapping ladle and means for substantially precluding ambient atmospheric contact between the molten steel passing through the bottom discharge passage and into the bottom pouring system, said means for substantially precluding ambient atmospheric contact being an impervious shroud means whose upper end portion is pressed against the bottom of the ladle and whose lower end portion is contoured to make contact with the bottom pouring system, and a source of inert gas under pressure greater than atmospheric pressure which opens into the shroud means whereby the inert gas atmosphere inside the shroud means is above atmospheric pressure during teeming.

7. The system of claim 6 further characterized in that the upper end portion of the shroud means includes deformable fibrous ceramic material whose upper surface contacts the bottom of the ladle and whose lower surface contacts the shroud means, whereby, when the ladle, the shroud means, and the bottom pouring system are in pressure contact with one another, a partial seal between the components is created which enables the inert gas under pressure to substantially displace the initial ambient atmosphere inside the shroud means.

8. The system of claim 6 further characterized in that the shroud means and the tapping ladle carry locking means which connect the shroud means to the tapping ladle prior to application of pressure contact between the tapping ladle, the shroud means and the bottom pouring system.

* * * * *